United States Patent [19]

Wakao

[11] 4,376,579

[45] Mar. 15, 1983

[54] ELECTROSTATIC COPYING APPARATUS HAVING AN EASILY REMOVABLE PHOTOSENSITIVE DRUM

[75] Inventor: Nobutaka Wakao, Kawasaki, Japan

[73] Assignee: Tokyo Shibaura Denki Kabushiki Kaisha, Kawasaki, Japan

[21] Appl. No.: 238,652

[22] Filed: Feb. 26, 1981

[30] Foreign Application Priority Data

Feb. 29, 1980 [JP] Japan ..... 55-25103

[51] Int. Cl.[3] ..... G03G 15/00

[52] U.S. Cl. ..... 355/3 DR; 355/133

[58] Field of Search ..... 355/3 DR, 3 R, 133

[56] References Cited

U.S. PATENT DOCUMENTS 3,966,316 6/1976 Pfeifer ..... 355/3 DR
3,997,262 12/1976 Doi et al. ..... 355/3 R
3,998,548 12/1976 Wakatsuki ..... 355/3 DR
4,114,998 9/1978 Shimizu et al. ..... 355/3 DR
4,124,289 11/1978 Miyata et al. ..... 355/10 X
4,325,626 4/1982 Murata ..... 355/3 DR

*Primary Examiner*—R. L. Moses
*Attorney, Agent, or Firm*—Cushman, Darby & Cushman

[57] ABSTRACT

A case for an electrostatic copying apparatus includes a lower casing section and an upper casing section swingably pivoted on one end of the lower casing section. A support mechanism is attached to the upper casing section for detachably supporting a photosensitive drum. A guide mechanism is attached to the lower casing section, and extends between a first position under the support mechanism and a second position at the other end of the lower casing section. The guide mechanism directs the removed drum from the first position to the second position as the drum is removed, and directs the drum to from the second position to the first position as the drum is inserted.

13 Claims, 13 Drawing Figures

FIG. 2A
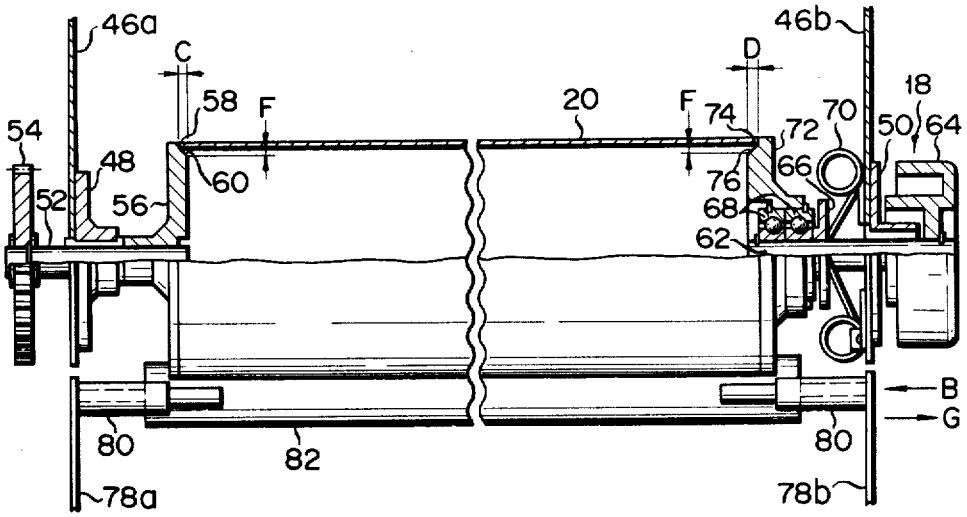
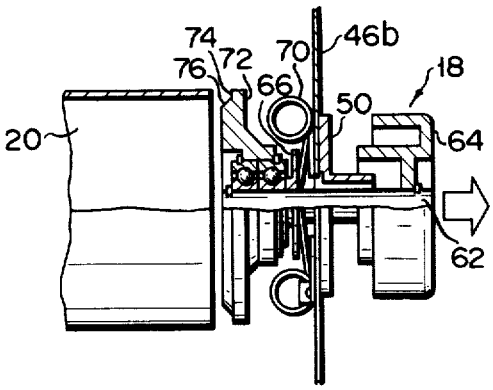
FIG. 2B
FIG. 3
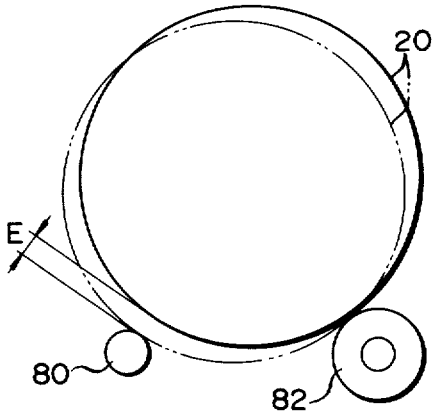

ELECTROSTATIC COPYING APPARATUS HAVING AN EASILY REMOVABLE PHOTOSENSITIVE DRUM

BACKGROUND OF THE INVENTION

This invention relates to an electrostatic copying apparatus having a photosensitive drum, more specifically to an electrostatic copying apparatus with a vertically separated casing.

Generally, an electrostatic copying apparatus is provided with a photosensitive drum having a photosensitive layer on its outer peripheral surface. It is known that the copying performance of a copier with a photosensitive drum of this type deteriorates as a result of soiling or a deterioration of the electrostatic property of the photosensitive layer after the passage of a given period of time or after a number of copies are made. In order to prevent this deterioration in copying performance, the photosensitive drum must be removed from the casing for cleaning or replacement. The complicated internal mechanism of the apparatus, however, renders very difficult the task of removing the photosensitive drum.

To facilitate the removal and insertion of the photosensitive drum, therefore, a copier has recently been proposed having a casing which is divided vertically into two parts—upper and lower casing sections—swingably mounted on one end of each other so that the upper casing section may be swung relative to the lower casing section as required. In such a split structure, the photosensitive drum is removably mounted on the upper casing section. The photosensitive drum moves with the upper casing section as it is swung upward. In removing the photosensitive drum from the casing, therefore, the upper casing section is first swung upward to form an opening on the opposite side to the pivotal point. Then, the photosensitive drum is removed from the upper casing section through the opening.

However, the photosensitive drum in the upper casing section is surrounded by a charging unit, developing unit, cleaning unit, etc. In the removing operation, therefore, care must be taken to ensure that the photosensitive drum avoids these surrounding units. Since the photosensitive drum is disposed in the vicinity of the pivotal point positioned between the upper and lower casing sections, far from the opening or outlet, an operator must reach far into the copier to remove the photosensitive drum through the opening, which suggests an extremely unstable and strenuous operation. In consequence, an operator struggling with the photosensitive drum may be unable to prevent the drum from hitting the surrounding units and damaging them as well as the drum. Thus, the removal and insertion operations for the photosensitive drum are not only nerve racking for the operator, troublesome and inefficient.

SUMMARY OF THE INVENTION

Accordingly, the object of this invention is to provide an electrostatic copying apparatus in which a photosensitive drum may easily be removed from and inserted into a casing, thus improving operating efficiency.

According to an aspect of this invention, there is provided an electrostatic copying apparatus which comprises a casing including a lower casing section and an upper casing section swingably pivoted on one end of the lower casing section, a photosensitive drum, a support mechanism attached to the upper casing section supporting the photosensitive drum detachably from the upper casing section, and a guide mechanism attached to the lower casing section and extending between a first position under the support mechanism and a second position at the other end of the lower casing section, whereby the removed photosensitive drum will be guided from the first position to the second position in the removal of the photosensitive drum, and the photosensitive drum to be mounted will be guided from the second position to the first position in the setting of the photosensitive drum.

BRIEF DESCRIPTION OF THE DRAWINGS

FIG. 2A is a half-sectional view showing a photo-sensitive drum along with a support mechanism;

FIG. 2B is a half-sectional view showing a different operating state from the one shown in FIG. 2A;

FIG. 3 is a structural diagram for illustrating a receiving pin of a guide mechanism;

DETAILED DESCRIPTION OF THE PREFERRED EMBODIMENTS

Now an electrostatic copying apparatus according to one embodiment of the present invention will be described in detail with reference to the accompanying drawings.

Figure 1:
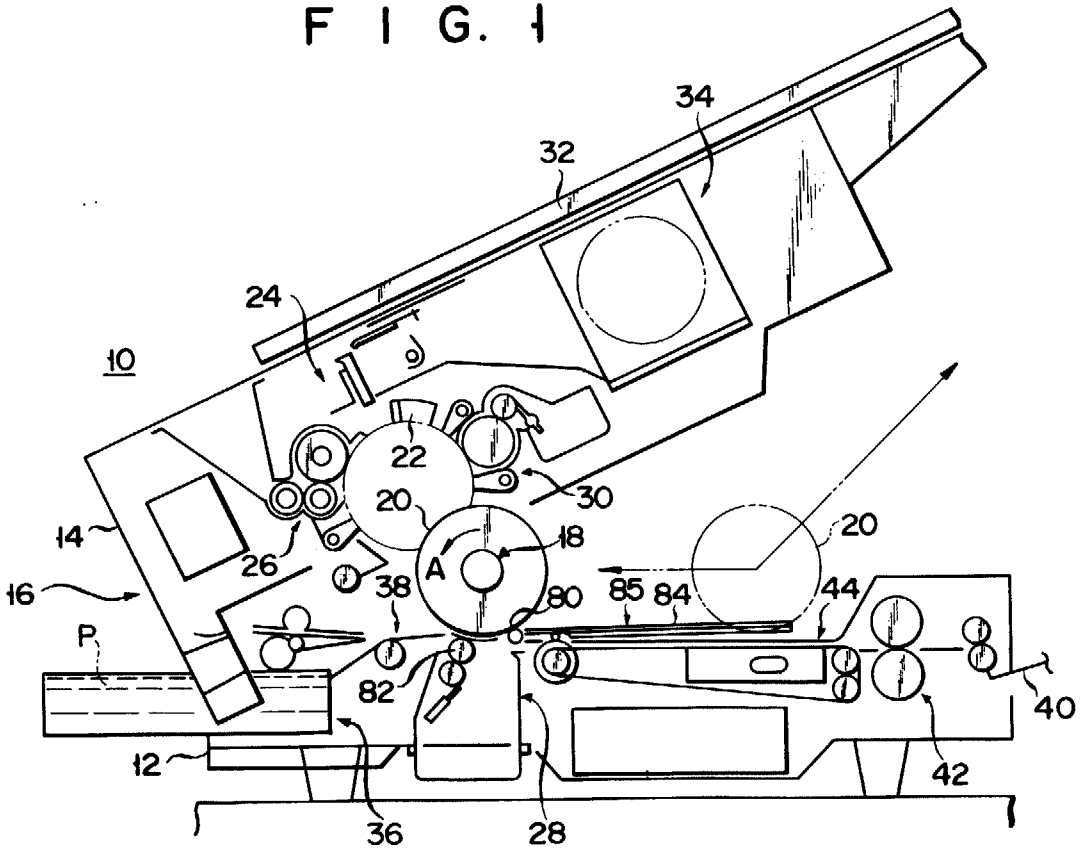
FIG. 1 schematically shows an electrostatic copying apparatus according to one embodiment of this invention.

In FIG. 1, numeral 10 designates the main body of the copying apparatus. The main apparatus body 10 includes a casing 16 composed of upper and lower casing sections 12 and 14. The upper casing section 14 is swingably attached to the lower casing section 12 by means of a hinge mechanism (not shown) fixed to one ends of these casing sections. A support mechanism 18 as mentioned in detail later is disposed at a substantially central portion of the upper casing section 14. The support mechanism 18 supports a photosensitive drum 20 in such a way that the drum 20 may rotate and may be detached from it. The photosensitive drum 20 is driven to rotate counterclockwise or in the direction of an arrow A by a driving mechanism (not shown).

A charge unit 22, exposure unit 24, developing unit 26, transfer unit 28, and cleaning unit 30 are successively arranged around the photosensitive drum 20 along the rotating direction thereof. Among these surrounding units, only the transfer unit 28 is attached to the lower casing section 14, whereas the remaining units are attached to the upper casing section 12. Further, all these surrounding units but the exposure unit 24 are so designed as to be at least partially in rolling contact with the outer peripheral surface of the photosensitive drum 20 under a predetermined pressure so as to perform a proper copying operation.

The developing unit 26 and the cleaning unit 30 are each provided with retreating mechanisms (not shown), and are moved from the surface of the photosensitive drum 20 by these retreating mechanisms as the upper casing section 14 swings upward. Further, an original rest 32 is set on the top of the upper casing section 14 so as to be able to reciprocate. A cooling unit 34 is disposed in a fixed position inside the upper casing section 14.

A paper feeder 36 storing a pile of copying paper P is attached to one end side of the lower casing section 12. Inside the lower casing section 12 extends a first paper conveyor 36 which connects the paper feeder 36 and the transfer unit 28. Moreover, a discharge tray 40 to receive the copying paper P after copying is attached to the other end side of the lower casing section 12. Adjoining the outlet tray 40, a fixing unit 42 is disposed inside the lower casing section 12. Between the fixing unit 42 and the transfer unit 28 extends a second paper conveyor 44 through which the copying paper P subjected to transcription by the transfer unit 28 is carried to the fixing unit 42.

Referring now to FIGS. 2A and 2B, the photosensitive drum 20 and the support mechanism 18 will be described in detail.

The photosensitive drum 20 includes a hollow cylindrical drum body and a photosensitive layer of photoconductive material such as zinc oxide-resin disperse material which is formed over the outer peripheral surface of the drum body. The drum body is formed of a thin-wall aluminum cylinder. The axial dimension of the photosensitive drum 20 is greater than the width of the copying paper P. Here the width of the copying paper P is defined as a length along a direction across a traveling direction of the copying paper P. The circumferential length or development length of the photosensitive drum 20 is shorter than the length of the copying paper P along its traveling direction. The wall thickness of the photosensitive drum 20 is set within a range from 1 to 2 mm. Having such wall thickness, the photosensitive drum 20 can be rigid enough to stand the pressure from the aforesaid surrounding units in rolling contact therewith without suffering any distortion.

The support mechanism 18 removably supporting the photosensitive drum 20 is attached to the upper casing section 14, and includes first and second mounting plates **46*a* and 46*b* detachedly facing each other and attached to the upper casing section 14 respectively, a slide bearing section 48 attached to the first mounting plate 46*a*, and a flanged bearing section 50 attached to the second mounting plate 46*b* in a position opposite to the slide bearing section 48. A first shaft 52 is rotatably mounted on the slide bearing section 48. One end of the first shaft 52 is projected into an inside region defined between the first and second mounting plates 46*a* and 46*b*, while the other end protrudes outward from the first mounting plate 46*a*. A driven gear 54 is fitted on the other end of the first shaft 52**, and is rotated by a driving source (not shown).

A first flange section 56 is fitted coaxially on the one end of the first shaft 52. A first support section supporting one side portion of the photosensitive drum 20 is formed at the peripheral portion of that side of the first flange section 56 which faces the second mounting plate **46*b*. The first support section is composed of an annular flat portion 58 engaging one side face of the photosensitive drum 20 and an annular taper portion 60 bent from the inner periphery of the flat portion 58 and linearly reduced in its diameter toward the second mounting plate 46*b*. The axial thickness of the taper portion 60 is designated by C in FIG. 2A. The diameter of the inner periphery of the flat portion 58 or the outer periphery of the taper portion 60 is equal to the inside diameter of the photosensitive drum 20, and the diameter of the outer periphery of the flat portion 58 is equal to the outside diameter of the photosensitive drum 20**.

A second shaft 62 is loosely fitted in the flanged bearing section 50 so as to be able to slide along the axial direction. One end of the second shaft 62 protrudes into the inside region, whereas the other end protrudes outward from the second mounting plate **46*b*. A knob 64 is fitted on the other end of the second shaft 62. A discoid spring receiver 66 and a pair of bearings 68 are successively fitted on the one end of the second shaft 62. A set spring 70 is interposed between the spring receiver 66 and the second mounting plate 46*b*. Both ends of the set spring 70 severally abut on the second mounting plate 46*b* and the spring receiver 66, thereby urging the second shaft 62** inward or in the direction of an arrow B.

A second flange section 72 is fitted on the outer peripheries of the bearings 68 so as not to move thereof along the axial direction. Thus, the second flange section 72 can rotate around the second shaft 62 with the aid of the bearings 68. A second support section supporting the other side portion of the photosensitive drum 20 is formed at the peripheral portion of that side of the second flange section 72 which faces the first flange section 56. The second support section is composed of an annular flat portion 74 engaging the other side face of the photosensitive drum 20 and an annular taper portion 76 bent from the inner periphery of the flat portion 74 and linearly reduced in its diameter toward the first flange section 56. The axial thickness of the taper portion 76 is designated by D in FIG. 2A. The diameter of the inner periphery of the flat portion 74 or the outer periphery of the taper portion 76 is equal to the inside diameter of the photosensitive drum 20, and the diameter of the outer periphery of the flat portion 74 is equal to the outside diameter of the photosensitive drum 20.

The second flange section 72 is moved in the direction of the arrow B by the urging force of the set spring 70, so that the photosensitive drum 20 is held between the flat portion 58 of the first flange section 56 and the flat portion 74 of the second flange section 72. Thus, the photosensitive drum 20 is stopped by the taper portion 60 of the first flange section 56 and the taper portion 76 of the second flange section 72. The photosensitive drum 20 is brought to frictional engagement with the flat portions 58 and 74 by the urging force of the set spring 70, and rotates as the second flange section 56 rotates in accordance with the rotation of the driven gear 54.

The second shaft 62 is so set that it may be moved along the axial direction over a distance greater than the sum of the axial thicknesses of the taper portions 56 and 76, i.e. C+D, by pulling the knob 64 on the second shaft 62 in a direction opposite to the direction of the arrow B against the urging force of the set spring 70.

Third and fourth mounting plates **78*a* and 78*b* are attached to the lower casing section 12 so that they may be located respectively under the first and second mounting plates 46a and 46b on the upper casing section 14 when the upper casing section 14 is coupled with the lower casing section 12. Two receiving pins 80 are severally attached to the third and fourth mounting plates 78a and 78b so as to be able to support the bottom portion of the photosensitive drum 20. With the photosensitive drum 20 supported by the support mechanism 18, the surface of the photosensitive drum 20 is separated from the surface of each receiving pin 80 at a given space (designated by E in FIG. 3). The given space E is narrower than the radial length (designated by F in FIG. 2A) of each of the taper portions 60 and 76 of the first and second flange sections 56 and 72. As shown in FIG. 3, the central axis of the photosensitive drum 20 is located between that of each receiving pin 80 and that of a transfer roller 82 of the transfer unit 28 in rolling contact with the outer peripheral surface of the photosensitive drum 20. Also, the gap between the transfer roller 82 and the receiving pins 80 is narrower than the diameter of the photosensitive drum 20. Accordingly, when the photosensitive drum 20 is removed from the support mechanism 18, the receiving pins 80 receive the dropped photosensitive drum 20, and sustain the photosensitive drum 20 in cooperation with the transfer roller 82**, as indicated by a two dots-dash line in FIG. 3.

Figure 4:
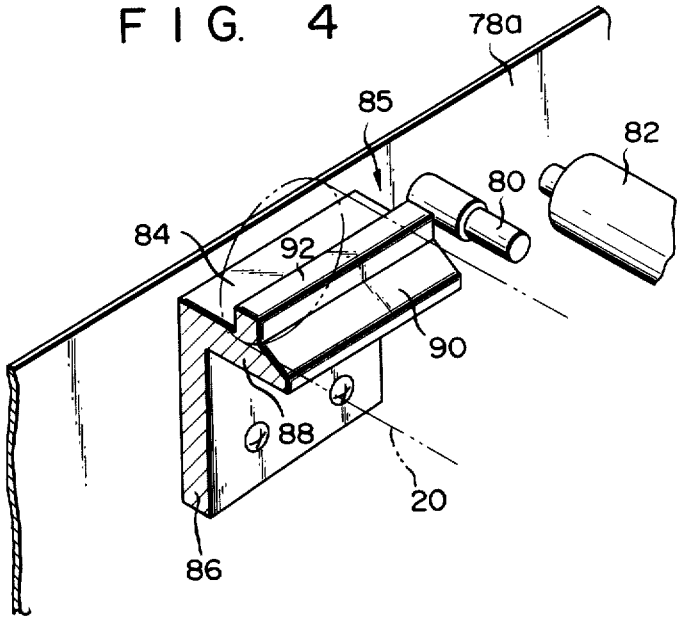
FIG. 4 is a perspective view of the guide mechanism.
Figure 5:
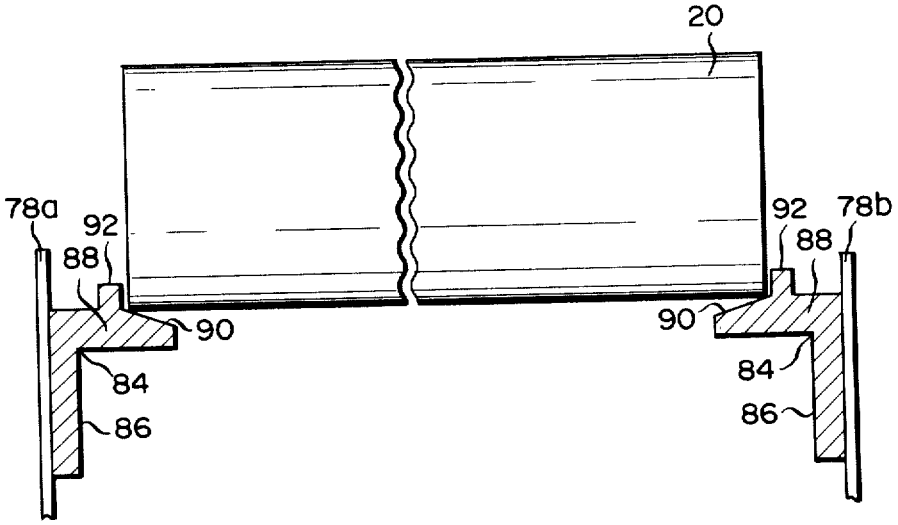
FIG. 5 is a sectional view showing the photosensitive drum along with the guide mechanism.

Two guide rails 84 are severally attached to the third and fourth mounting plates 78a and 78b on the opposite side of the receiving pins 80 to the transfer roller 82. The guide rails 84 extend horizontally between the vicinity of their corresponding receiving pins 80 and the other end portions (opposite to the hinge mechanism side) of the lower casing section 12. These guide rails 84, along with the receiving pins 80, constitute a guide mechanism 85. As shown in FIGS. 4 and 5, the guide rails 84 are substantially reverse L-shaped in section, each including an upright fixing portion 86 and a support portion 88 horizontally extending inward from the top edge of the fixing portion 86. The upper surface of the support portion 88 has a taper surface 90 as a guide surface which is lowered from the middle portion of the upper surface toward its distal end. An elongated projection 92 extending along the same direction with the guide rail 84 is located in the middle of the upper surface of each support portion 88, that is, at the proximal end of the taper surface 90. The respective elongated projections 92 of the two guide rails 84 run parallel with each other, and the space between them is a little greater than the axial length of the photosensitive drum 20. Namely, as is evident from FIG. 5, the lower edges of both end faces of the photosensitive drum 20 are pointedly supported by the taper surfaces 90.

Now there will be described the operation of the electrostatic copying apparatus of the above-mentioned construction.

When a copying button (not shown) is depressed with the upper casing section 14 coupled with the lower casing section 12, the driving mechanism reciprocates the original rest 32 and rotates the photosensitive drum 20 with the aid of the driven gear 54. At the same time, the surrounding units perform their respective operations, and the copying paper P which has obtained a reproduced picture through well-known copying processes is discharged into the discharge tray 40.

During such copying operation, the copying paper P may sometimes be jammed in the first or second paper path 38 or 44, or at the transfer section between the surface of the photosensitive drum 20 and the transfer unit 28. In this case, the upper casing section 14 is first swung upward around the hinge mechanism to be separated from the lower casing section 12. By such separation, the top of the lower casing section 12 is opened, and the first and second paper paths 38 and 44 are exposed to the outside. Kept supported by the support mechanism 18, the photosensitive drum 20 (as represented by a dot-dash line in FIG. 1) moves with the upward swing of the upper casing section 14. As a result, the transfer unit 28 is also exposed to the outside. Thus, since all the regions that may be subject to paper jamming are exposed to the outside, jammed paper can immediately be removed with ease wherever it is jammed.

The photosensitive drum 20 is removed in the following manner. Before the upper casing section 14 is swung upward, the knob 64 of the support mechanism 18 is pulled in the direction of an arrow G (shown in FIG. 2B) opposite to the direction of the arrow B. As a result, the second flange section 72 moves in the direction of the arrow G against the urging force of the set spring 70 through the second shaft 62 and the paired bearings 68. By such movement, the flat portion 74 and the taper portion 76 of the second flange section 72, which have so far supported the other end face of the photosensitive drum 20, cease to do that, as shown in FIG. 2B. Accordingly, the photosensitive drum 20 falls along the taper portion 58 of the first flange section 56 by its own weight, and is received by the pair or receiving pins 80 constituting the guide mechanism 85. As a result, the photosensitive drum 20 is released from the support mechanism 18, and is supported by the guide mechanism 85 on the lower casing section 12.

In this state, the upper casing section 14 is swung upward. Then, the top of the lower casing section 12 supporting the photosensitive drum 20 received by the pair of receiving pins 80 and the transfer roller 82 is exposed to the outside, as indicated by a solid line in FIG. 1. Namely, the upper casing section 14 is swung upward without being accompanied by the photosensitive drum 20. Subsequently, the photosensitive drum 20 is moved onto the taper surface 90 at one end portion of the guide rail 84 in close vicinity to each receiving pin 80. Then, the photosensitive drum 20 is rolled along the guide rail 84 to the other end portion thereof where the upper casing section 14 opens wide apart from the lower casing section 12. In doing this, the moving direction of the photosensitive drum 20 is regulated by the elongated projection 92 of the guide rail 84 so that the photosensitive drum 20 will never run off the guide rail 84. The photosensitive drum 20 located at the other end portion of the guide rail 84 is taken out of the casing 16 without running against any peripheral mechanisms or other members. Since the guide rails 84 support the photosensitive drum 20 in the point-contact manner, the photosensitive drum 20 can easily roll on the guide rails 84.

The photosensitive drum 20 is set in place as follows. First, the upper casing section 14 is swung upward. As a result, the top of the lower casing section 12 is exposed to the outside. In this state, the photosensitive drum 20 is put on the other end portion of each guide rail 84 so that the lower edge of each end face of the photosensitive drum 20 is pointedly supported by the taper surface 90 of the guide rail 84. Namely, the photosensitive drum 20 is to be held between the respective elongated projections 92 of the two guide rails 84. The photosensitive drum 20 is rolled up to the one end portion of the guide rail 84, and then displaced from the guide rails 84 to be supported by the receiving pins 80 and the transfer roller 82. In this state, the photosensitive drum 20 has its position settled precisely. Then, the upper casing section 14 is swung downward to be coupled with the lower casing section 12.

Figure 6A:
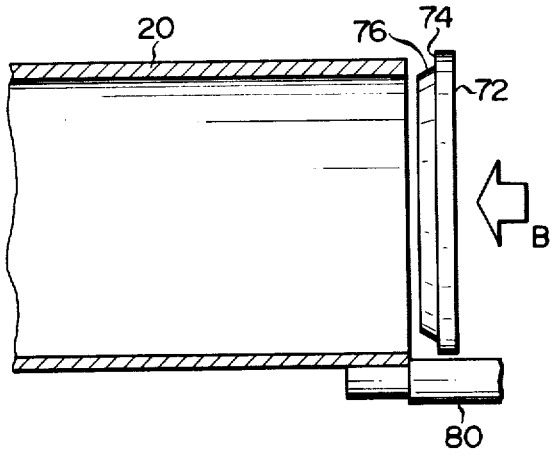
FIGS. 6A to 6C are partial sectional views showing various operating states of the support mechanism.
Figure 6B:
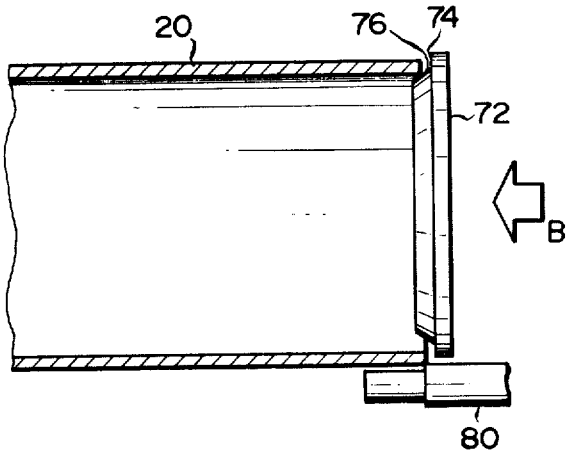
Figure 6C:
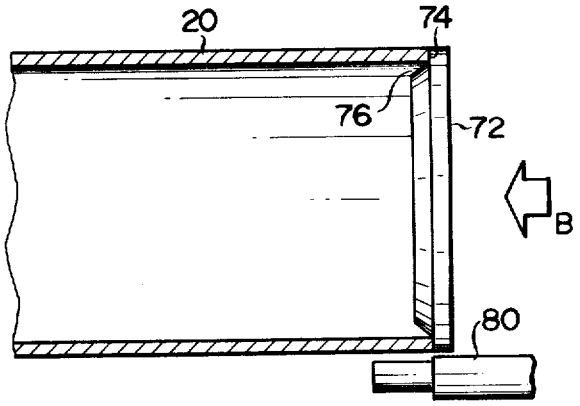

In this state, the knob 64 is pushed inward in the direction of the arrow b with the aid of the urging force of the set spring 70 to cause the photosensitive drum 20 to be supported by the support mechanism 18. Namely, the photosensitive drum 20 is supported by the support mechanism 18 in steps of procedure as shown in FIGS. 6A to 6C. First, the second flange section 72 engages the other end face of the photosensitive drum 20 supported by the receiving pins 80 and the transfer roller 82 (not shown), as shown in FIG. 6A, as the knob 64 is moved. More specifically, the taper portion 76 of the second flange section 72 engages the edge of an opening in the other end face of the photosensitive drum 20. As the knob 64 is further moved, the second flange section 72 moves in the direction of the arrow B to displace the photosensitive drum 20 upward along the taper portion 76 of the second flange section 72, as shown in FIG. 6B. The second flange section 72 is moved until the flat portion 74 of the second flange section 72 abuts on the end face of the photosensitive drum 20, as shown in FIG. 6C. In this state, the photosensitive drum 20 is separated from the receiving pins 80 at the given space. Since the first and second flange sections 56 and 72 are pressed against their corresponding end faces of the photosensitive drum 20 by the urging force of the set spring 70, the photosensitive drum 20 rotates by means of frictional engagement between them as the first flange section 56 rotates.

Figure 7:
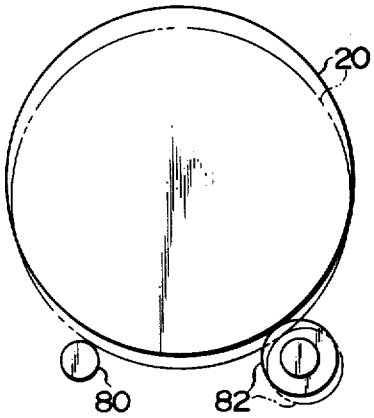
FIG. 7 is a side view schematically showing a support mechanism according to another embodiment of the invention.

This invention is not limited to the above-mentioned embodiment, and various changes and modifications may be effected therein without departing from the scope or spirit of the invention. For example, although the transfer roller 82 is fixed in the aforesaid embodiment, it may be so designed as to move in concert with the operation of the support mechanism 18, as shown in FIG. 7. Namely, when the knob 64 is pulled in the direction of the arrow G, the transfer roller 82 is moved from a position represented by a solid line in FIG. 7 to a position represented by a two dots-dash line. In the shifted position, the transfer roller 82 supports the photosensitive drum 20 in cooperation with the receiving pins 80. Naturally, in this case, the receiving pins 80 will not be in contact with the photosensitive drum 20 when the photosensitive drum 20 is supported by the support mechanism 18.

Figure 8:
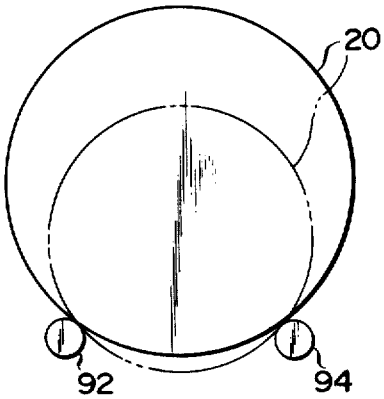
FIG. 8 is a side view showing a modification of the support mechanism shown in FIG. 7.

In an electrostatic copying apparatus including a transfer unit of a no-contact type in which the transfer roller 82 is not used, it is necessary only that first and second receiving pins 94 be arranged at a space at least narrower than the diameter of a minimum-diameter photosensitive drum, as shown in FIG. 8. With such construction the receiving pins, 94 may directly be used with photosensitive drums of various diameters. Here a separating roller may be utilized as the receiving pin 94.

Figure 9:
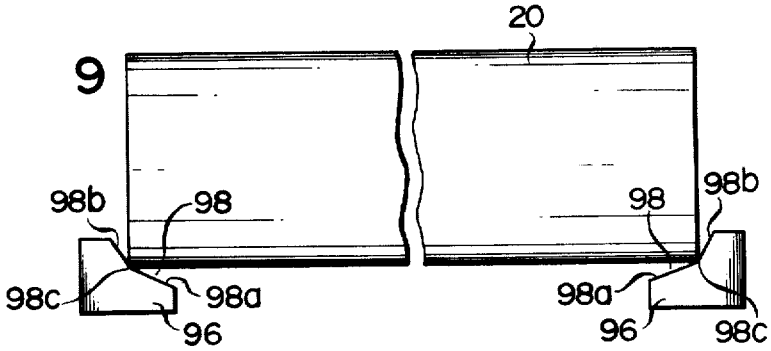
FIG. 9 is a front view showing a first modification of the guide mechanism shown in FIG. 5.

Moreover, guide rails 96 may be constructed as shown in the sectional view of FIG. 9. Namely, a taper surface 98 of each guide rail 96 includes first and second taper surface portions **98*a* and 98*b* with different gradients coupled by a connecting portion 98*c*. The respective connecting portions 98*c* of the two guide rails 96 run parallel with each other, and the space between them is equal to the axial length of the photosensitive drum 20. With such construction, the photosensitive drum rolling on the guide rails 96 can be guided by the connecting portions 98*c*** to be easily located in its correct position.

Figure 10:
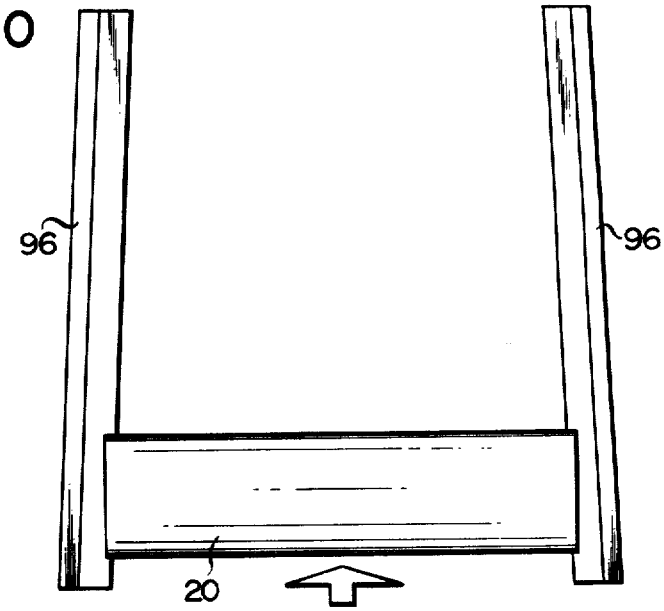
FIG. 10 is a plan view showing a second modification of the guide mechanism shown in FIG. 5.

Furthermore, the guide rails 96 be arranged as shown in FIG. 10. Namely, the space between the pair of guide rails 96 is gradually narrowed toward one end portion. Therefore, the photosensitive drum 20 is regulated by the taper surfaces 98 to be lifted as it rolls on the guide rails 96 from the other end portion to the one end portion thereof. At the one end portion, the two guide rails 96 are spaced at such a distance that the photosensitive drum 20 may be maintained in a predetermined position. Thus, the photosensitive drum 20 rolling on the guide rails 96 can be set in the predetermined position without any special positioning operation.

What is claimed is:

1. An electrostatic copying apparatus comprising:

a casing including a lower casing section and an upper casing section pivotably connected to one end of said lower casing section for movement between an open position and a closed position;

a photosensitive drum;

support means attached to said upper casing section for releasably supporting said photosensitive drum in said upper casing section; and guide means attached to said lower casing section and extending between a first position under said support mechanism on one side of said casing and a second position at an end of said casing on a side opposite said one side, for guiding said photosensitive drum after removal from said support means between said first and second positions, said guide means including a pair of rails each continuously extending between a position adjacent to said first position and said second position, said rails having guide surfaces inclined relatively to the rotating axis of said photosensitive drum, said guide surfaces being in point-contact with the bottom edges of the end faces of said photosensitive drum to support said drum.

2. An electrostatic copying apparatus according to claim 1, wherein said guide means includes rest means for supporting said photosensitive drum in said first position.

3. An electrostatic copying apparatus as in claim 1, further comprising transfer means for moving said photosensitive drum between said support means and said first position of said guide means while said upper casing section is in said closed position.

4. An electrostatic copying apparatus according to claim 1, wherein said rails run parallel with each other and have elongated projections formed on the upper surfaces thereof and extending along the extending direction of the rails, said elongated projections running parallel with each other so that the distance between said projections is greater than the axial length of said photosensitive drum.

5. An electrostatic copying apparatus according to claim 1, wherein each said guide surface includes first and second guide surface portions with different gradients.

6. An electrostatic copying apparatus according to claim 5, wherein said rails run parallel with each other, and the distance between border lines between the respective first and second guide surface portions of said rails is equal to the axial length of said photosensitive drum.

7. An electrostatic copying apparatus according to claim 5, wherein the space between said rails is gradually narrowed toward said rest means.

8. An electrostatic copying apparatus according to any one of claims 2 and 4 to 7, wherein said rest means includes two pairs of fixed pins, said pins in each of said pairs spaced apart from each other, said pairs of pins for supporting said photosensitive drum on both ends thereof.

9. An electrostatic copying apparatus according to claim 8, wherein each said pair of fixed pins are arranged at a space narrower than the minimum photosensitive drum diameter used.

10. An electrostatic copying apparatus according to any one of claims 2 and 4–7 wherein there is further provided a transfer unit including a transfer roller to be brought in contact with the outer peripheral surface of said photosensitive drum, and said rest means is placed under said photosensitive drum and comprises the tranfer roller and two fixed pins spaced from each other and supporting the end portions of said photosensitive drum, respectively.

11. An electrostatic copying apparatus according to claim 10, wherein each of said fixed pins and said transfer roller are arranged at a space narrower than the minimum photosensitive drum diameter used.

12. An electrostatic copying apparatus according to claim 11, wherein said transfer roller is moved downward as said photosensitive drum is released from said support means, and said photosensitive drum is brought in contact with said fixed pins as said transfer roller is moved downward.

13. An electrostatic copying apparatus according to claim 1, wherein said support means includes a pair of flanges, each having a flat portion extending along the circumference of each end face circumference of said photosensitive drum to be pressed against said end face and a taper portion extending along the inner periphery of said flat portion for regulating the position of said photosensitive drum as said photosensitive drum is attached or detached, at least one of said flanges being able to move along the axial direction of said photosensitive drum.

* * * * *